US005890632A

United States Patent [19]

Chalupsky et al.

[11] Patent Number: 5,890,632

[45] Date of Patent: Apr. 6, 1999

[54] DISPENSING PUMP HAVING UNIVERSAL PUMP BODY AND READILY ATTACHABLE SHROUD SELECTED FROM READILY ATTACHABLE SHROUDS OF DIFFERENT OUTWARD SHAPES

[75] Inventors: William E Chalupsky, Woodbury, Minn.; Scotty Ferrell, Put-In Bay, Ohio; Gennaro R. Martire, Toledo, Ohio; Wing-Kwong Keung, Perrysburg, Ohio

[73] Assignee: Owens-Illinois Closure Inc., Toledo, Ohio

[21] Appl. No.: 881,945

[22] Filed: Jun. 25, 1997

[51] Int. Cl.[6] ..... B67D 5/40; A62C 11/00

[52] U.S. Cl. ..... 222/383.1; 239/333; 222/384; 222/182

[58] Field of Search ..... 222/383.1, 384, 222/182; 239/333

[56] References Cited

U.S. PATENT DOCUMENTS 5,172,836 12/1992 Warner ..... 222/383.1
5,366,121 11/1994 Foster et al. ..... 222/383.1
5,706,984 1/1998 Tada et al. ..... 222/182
5,749,501 5/1998 Maas et al. ..... 222/384

*Primary Examiner*—Andres Kashnikow
*Assistant Examiner*—Keats Quinalty

[57] ABSTRACT

An attachable shroud and a dispensing pump with universal pump body upon which is formed outward flanges on top of a pump outlet tube which includes a rearward latching section. A rearwardly extending horizontal shelf is formed on the vertical tubular support of the pump body. The shroud is open-fronted and includes a top wall, connected side walls and a rear end wall with an inward horizontal shoulder. Extending downward along the top wall of the shroud are a pair of opposed channels to the rear of which are unitary downward locking wedges. In assembly, the open-fronted shroud is moved forward onto the pump body in a simple uni-directional linear movement, the channels receiving the outward flanges respectively. The latching sections are flexed downward by the locking wedges and snap past the wedges and the shoulder as the shroud slides under the shelf.

27 Claims, 4 Drawing Sheets

DISPENSING PUMP HAVING UNIVERSAL PUMP BODY AND READILY ATTACHABLE SHROUD SELECTED FROM READILY ATTACHABLE SHROUDS OF DIFFERENT OUTWARD SHAPES

FIELD OF THE INVENTION

This invention relates to a trigger-type pump dispenser comprising a pump body and a shroud covering the pump body. More specifically, the invention relates to means by which a shroud selected from a variety of shapes and colors may be readily attached to the pump body in a uni-directional linear movement as by automatic assembly equipment. It is especially suitable for, but, of course, not limited to, use with trigger-type dispensing pumps of the type described in the McKinney U.S. Pat. No. 4,161,288 issued Jul. 17, 1979.

BACKGROUND OF THE INVENTION

The prior art includes a number of trigger-type dispensers in which a selected shroud can be attached to the pump body. The prior art includes, for instance, the Hellenkamp U.S. Pat. No. 3,820,721 issued Jun. 28, 1974, wherein, for the purpose of identification, a shroud bearing an identification number can be snapped onto the body of a pump.

More with a view to satisfying consumer desires as to the appearance of the dispenser, there is the Cary et al U.S. Pat. No. 4,257,539 issued Mar. 24, 1981. In this patent, during assembly the front end of the shroud is hooked over the front end of the pump body with the rear of the shroud high in the air. In the final assembly motion, the rear of the shroud is pressed downward to snap over an edge of the pump body in an over-center installation.

Foster et al U.S. Pat. No. 5,366,121 issued Nov. 22, 1994, has a shroud formed with forward hooks which fit into appropriate openings in the pump body when the shroud is placed on the pump body.

The attachment of the shrouds of the prior art to pump bodies has not been as readily accomplishable by automatic assembly equipment as has been desired. Further, the attachment has lacked sufficient security to hold the body and shroud together as a unit in a reliable manner.

SUMMARY OF THE INVENTION

It is a object of the present invention to provide a shroud selectable from an infinite array of possible shroud shapes and colors and a universal pump body whereby the assembly of the selected shroud onto the body can be readily accomplished by automatic assembly equipment to result in an assembly of improved security.

The invention is a trigger-sprayer-type dispensing pump comprising a pump body having a pump chamber supported on a tubular support, the chamber having a generally horizontal outlet tube. A pair of spaced parallel webs extend upward from the outlet tube and have outward flanges at the tops thereof. Lengthwise the flanges are in two longitudinal sections interrupted by a space and comprise a rear latching section and a forward support section. A horizontal shelf extends outward from the tubular support at the rear spaced down from the flanges.

The shroud is an open-front unitary molded element having a top wall, connected wide walls and a rear end wall. Extending down along the top wall are a pair of opposed channels, to the rear of which are unitary locking ramps. A horizontal shoulder is unitarily formed inward from the rear end and side walls spaced down from the channels.

In assembly, the open-fronted shroud is moved from the rear onto the pump body in a uni-directional linear movement, the channels receiving the outward flanges respectively. As the latching sections encounter the locking ramps, the latching sections flex downward and then, after the locking ramps have passed, snap back up, locking the shroud on the pump body. At the same time, the horizontal shoulder engages the shelf on the tubular support and slides underneath it to hold the rear of the shroud down securely in place.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 4:
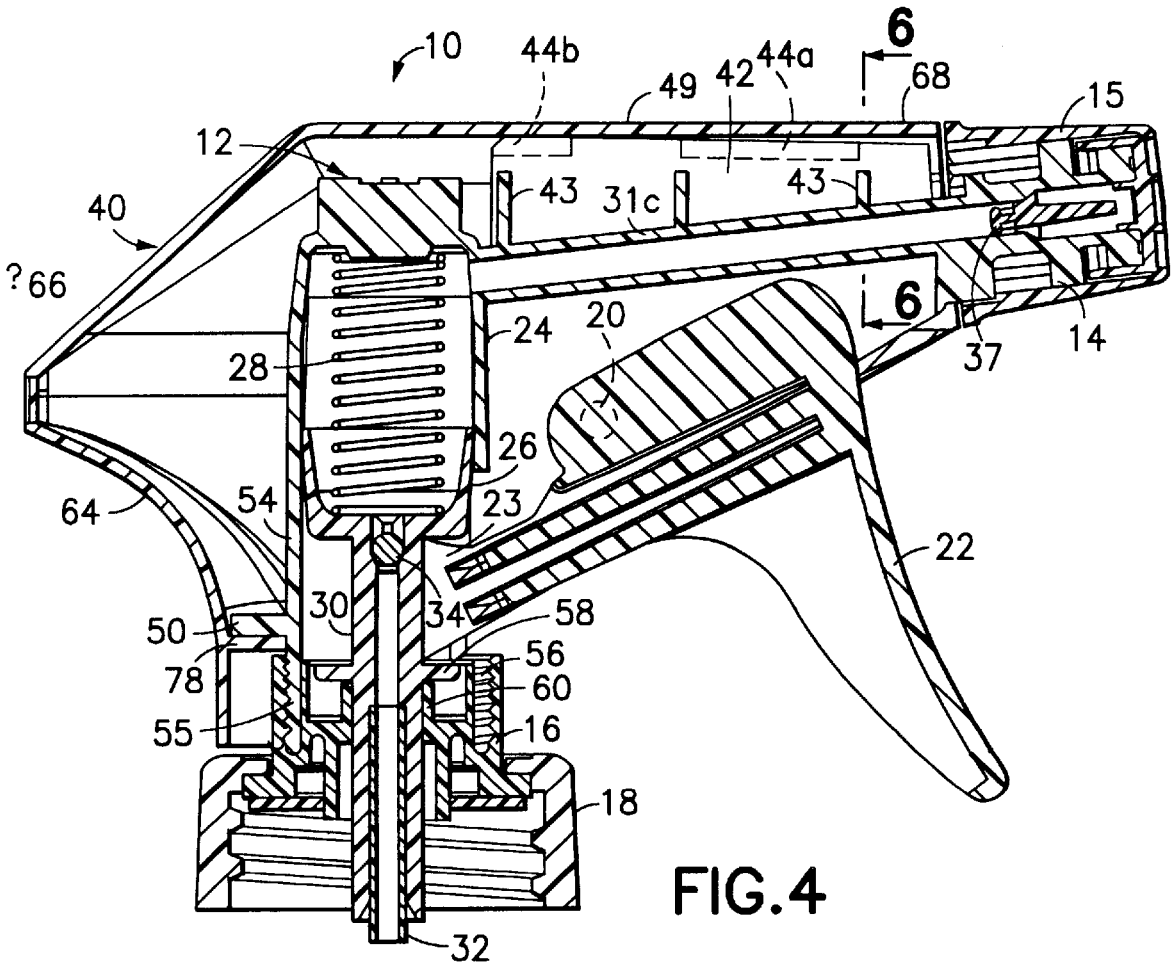
FIG. 4 is a sectional view taken on the centerline of a fully assembled trigger pump dispenser embodying the invention.

A dispensing pump embodying the invention is shown in section in FIG. 4 and generally designated 10. It comprises a pump body 12 formed with a nozzle 14 having a nozzle cap 15 secured on the front end thereof, a supporting collar 16 and a cap 18 by which the dispenser can be sealingly secured onto a container (not shown).

Pivotally secured in the pump body on trunions 20 is an operating trigger 22 having a working arm 23. The body 12 includes a cylinder 24 in which operates a piston 26 which may be biased downwardly by spring 28. The piston has a tubular stem 30 which extends downward therefrom and is connected to a dip tube 32. The stem is provided with an inlet ball check 34.

Extending outwardly from the upper end of the cylinder is a substantially horizontal outlet tube 36 which is provided with an outlet check 37 axially moveable in an enlarged space in the end of the outlet tube 36. The outlet tube may be angled slightly from the horizontal (for instance 7°) to promote draining toward the pump chamber in cylinder 24. The outlet check 37 is as described in the patent application Ser. No. 08/552,768 filed Nov. 3, 1995 by Richard J. Smolen, Jr. and assigned to the assignee of the present application. The disclosure of the Smolen, Jr. patent application is incorporated by reference hereinto. A shroud 40 is provided and fits over the body 12 to conceal it from view from most directions.

In operation, illustratively as in McKinney, when the trigger is squeezed toward the container, the piston is driven up by working arm 23, pushing liquid in the cylinder out through the outlet tube 36 past the outlet check 37 and through the nozzle 14. Other outlet check valves and nozzle configurations, such as shown in the McKinney patent, the disclosure of which is herein by reference, may be used.

When the trigger 22 is released, the piston is driven downward by spring 28, creating a vacuum which sucks liquid from the dip tube 32 up past the inlet ball check 34 into the chamber within the cylinder 24. The outlet check 37 performs as described in the Smolen application.

Figure 1:
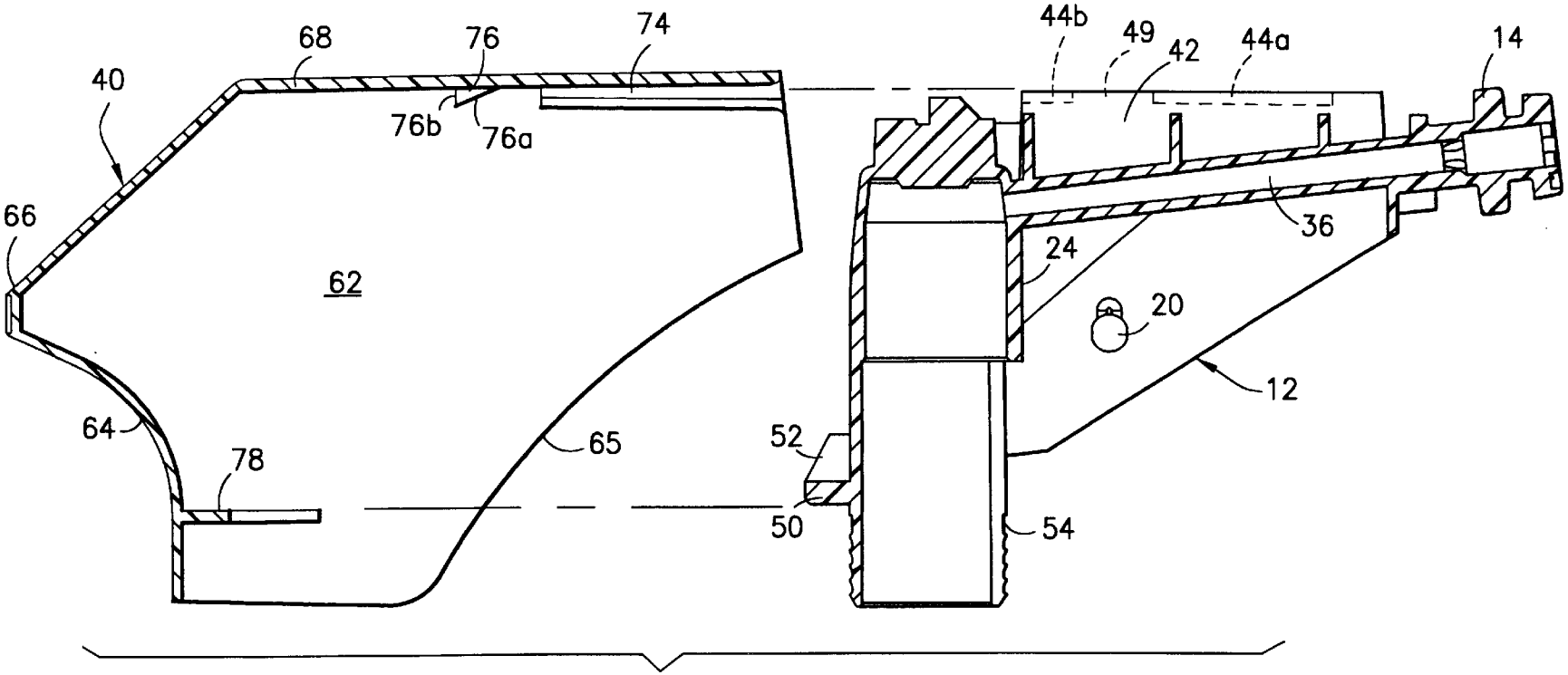
FIG. 1 is an exploded sectional view showing a pump body and shroud embodying the invention.

The present invention relates to the innovative shroud 40 and pump body 12 (FIG. 1). These parts are structured under the invention so that a selected shroud 40 can be mounted easily in permanent installation on the pump body 12. A benefit of the invention is that many different shaped and colored shrouds 40 can be designed for or made available for selection by a customer and the selected one can be installed on the pump body in a simple one-directional assembly motion.

Thus, it is possible to offer in the practice of the invention a variety of shrouds having the same internal characteristics but having different external or surface contours or appearances, the latter being determined by merchandising or consumer preferences.

Figure 3:
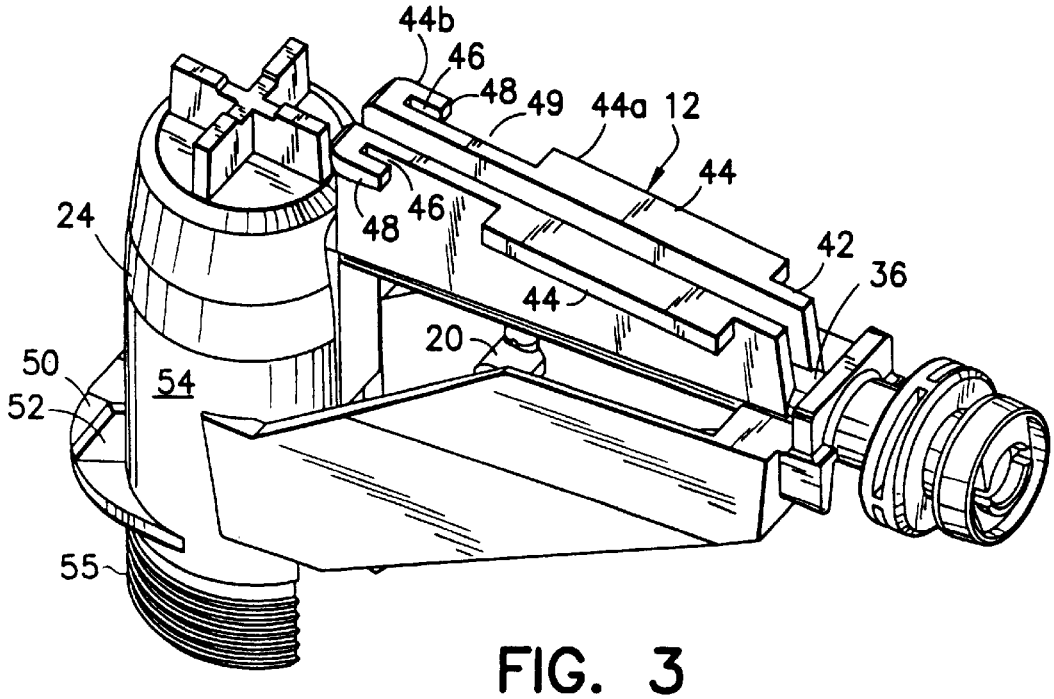
FIG. 3 is a perspective view from above of the pump body.

Attention is now directed to the pump body 12 as shown in FIGS. 3 and 4. The outlet tube 36 previously referred to has molded unitarily therewith a pair of spaced parallel vertical webs 42. The webs 42 are reinforced by transverse vanes 43. Along the upper end of the webs 42 extend outward flanges 44 which are each in two sections, a supporting section 44*a* and a latching section 44*b*. The latching section 44*b*, as shown best in FIG. 3, has a rearwardly running slot 46 which leaves the forward part of the latching section as a cantilevered finger 48. The slot 46 reduces the connection of the latching section 44*b* with the web to make the latching section 44*b* more able to flex for a purpose which will appear. Alternatively, the latching section 44*b* may be connected all along its short length to the web 42. The supporting section 44*a* and the latching section 44*b* are separated by an interruption 49 (FIGS. 1, 3 and 5).

Spaced downward below the cylinder and extending unitarily out from the body is a horizontal shelf 50 which may have unitary buttressing webs 52 spaced therealong to support the shelf from above against upward displacement. The pump body further comprises a tubular support 54 extending up to the cylinder 24 and supporting same. The lower end of the tubular support has serrations 55 on the outside and is pressed into a serrated annular channel 56 in the collar 16 in fixed installation. An outward annular stop flange 58 is formed unitarily with the piston stem 30 and serves as a stop for the lower end of travel of the piston as it hits an upward sleeve 60 of the collar 16. The stop flange 58 and the lower wall of the piston 26 entrap and provide working surfaces for the working arm 23 of the trigger 22.

Figure 2:
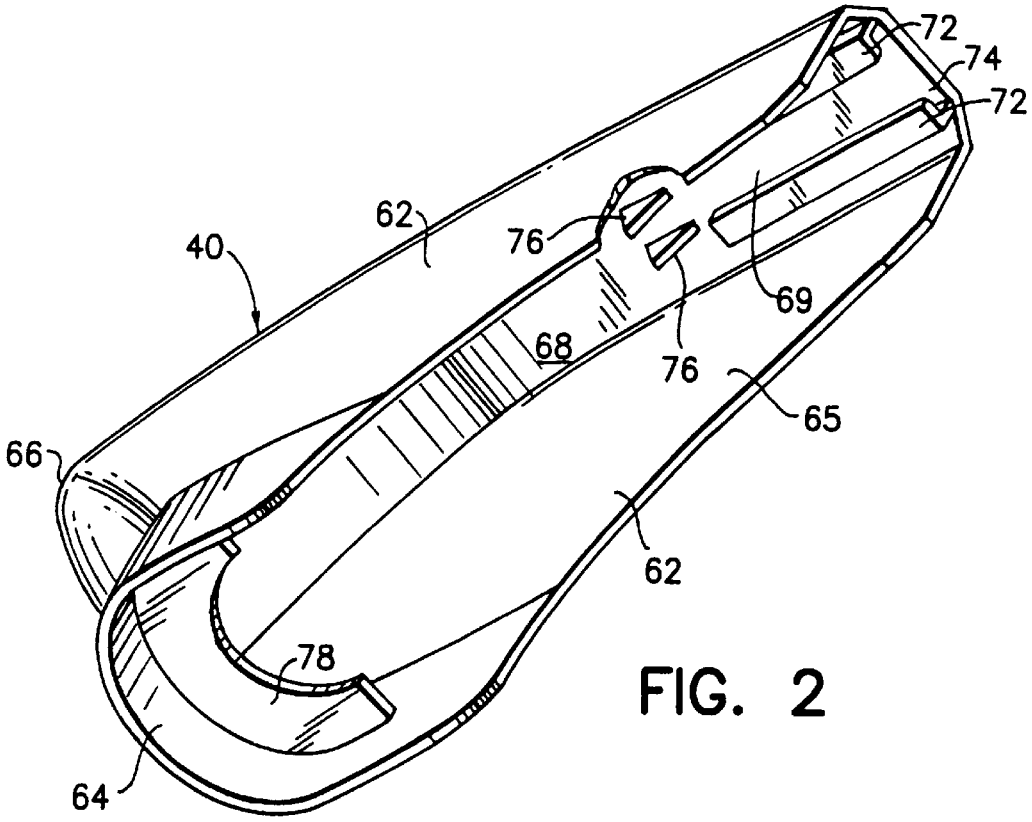
FIG. 2 is a perspective view from the underside of the shroud with a part of a side wall broken away.

The shroud 40 is shown in FIG. 2 and comprises side walls 62 and a curving rear end wall 64. It has an open front 65 (FIGS. 1, 2). As shown, the rear end wall 64 may extend gracefully rearward in its mid-section to a peak 66 which serves as a convenient rest for the web between thumb and index finger in manually operating the dispenser. The shroud is also formed unitarily with top wall 68. The top wall 68 may have downwardly angled portions 70 (FIG. 6) which meet the side walls 62 seamlessly.

Figure 5:
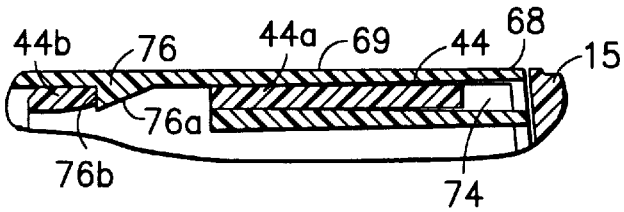
FIG. 5 is a fragmentary sectional view taken on the line 5—5 of FIG. 6.
Figure 6:
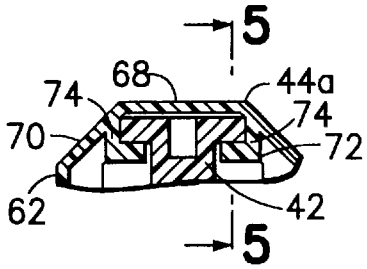
FIG. 6 is a fragmentary sectional view taken on the line 6—6 of FIG. 4.

As best shown in FIGS. 5, 6, the front portion 69 of the top wall 68, 70 is formed with downward L-shaped extensions 72 to define opposed channels 74 capable of receiving the flanges 44 of the pump body as will be explained.

Formed unitarily on the underside of the top wall 68 are locking wedges 76 (FIG. 5). They are positioned rearward from the channels 74 respectively and generally aligned therewith (FIG. 2). Each of the locking wedges 76 has a sloping portion 76*a* (FIG. 1) facing the aligned channel 74 and an abrupt vertical rear end 76*b*.

Unitarily formed in the molding of the shroud is the inward curving shoulder 78 (FIG. 2) which is inward from the rear end wall 64 and portions of the side walls 62.

The assembly of the shroud onto the pump body is a simple uni-directional linear movement. As shown in FIG. 1 with the aid of projection lines, the shroud 40 is initially positioned to the rear of the pump body 12 with its open front 65 facing the pump body. The shroud 40 is moved forward over the pump body 12 with the leading end of the channels 74 aligned respectively with the flanges 44 on the top of the pump body.

Figure 7A:
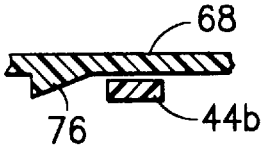
FIGS. 7*a*, 7*b* and 7*c* are fragmentary progressive views of one of the locking ramps of the shroud passing by one of the flexing latching sections on the pump body.
Figure 7B:
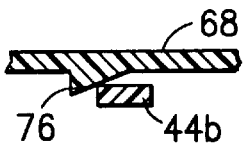
Figure 7C:
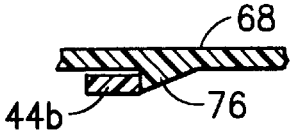

As this movement progresses, the latching sections 44*b* on the pump body enter the respective channels 74 (FIG. 7*a*) followed by the support sections 44*a*. When each latching section 44*b* encounters the locking wedges 76, the latching section 44*b* gradually flexes (FIG. 7*b*) downwardly. When the locking wedge 76 has passed the latching section 44*b*, the latching section 44*b* snaps back up so that it thereafter blocks retreat by engagement with 76*b* of the locking wedge 76 (FIG. 7*c*). The channels 74 hold the front of the shroud firmly against upward displacement with respect to the top of the pump body 12.

FIG. 5 shows in fragmentary section the completed installation of the shroud 40 onto the pump body 12 with one of the supporting section 44*a* installed in the channel 74 and latching section 44*b* snapped past the locking wedge 76.

Some time prior to the snapping engagement of the locking wedges 76 with the latching sections 44*b*, the shoulder 78 on the rear wall 64 of the shroud has engaged the underside of the shelf 50. As the forward movement of the shroud over the pump body continues, the shoulder 78 moves forward to "home" position under the shelf 50 (FIG. 4). Such engagement keeps the rear portion of the shroud 40 down on the pump body 12. This engagement and the engagement of the flanges 44 in channels 74 anchor the shroud 40 firmly against any vertical displacement from the pump body 12.

After the complete assembly of the accouterments—that is, the nozzle cap, trigger, spring, piston, and collar—onto the pump body, final assembly described above is a simple process readily accomplished by automatic assembly equipment. It involves merely the appropriate lining up of the flanges 44 and the channels 74 and the moving forward of the shroud over the pump body in a uni-directional linear movement. This shroud/pump body assembly is readily accomplished irrespective of any difference of the external shape of the shroud.

It is thus possible for the assembler to offer his customer a wide variety of shroud shapes and colors differing vastly from one another. When assembled with the selected shroud, the resulting dispensing pump has a totally different appearance from those with different shrouds. This is because the shroud is the major portion of the dispenser appearance.

Just as the assembly of shroud onto the pump body can be made after the assembly of the pump body with its accouterments, the shroud/pump body assembly can be made prior to installing the accouterments on the pump body. The invention is beneficial without regard to order of assembly.

It should be clear to those skilled in the art that a variety of other pump means can take the place of the piston pump 24, 26 disclosed. Such other pump mean—bellows pumps, rolling-walled chambers, etc.—are the structural equivalents of the pump shown.

Both the shroud 40 and the pump body 12 may be separate unitary molded parts of a plastic material such as polypropylene.

Modification

Figure 8:
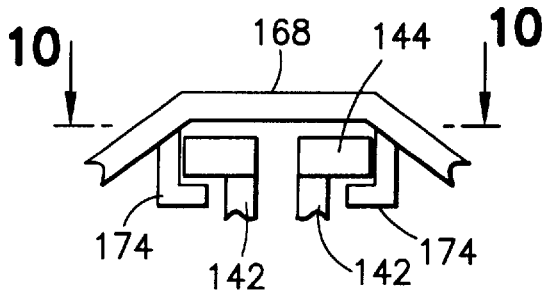
FIG. 8 is a sectional view comparable to FIG. 6 and showing a modified form of attachment.

Views of a modified form of the invention are in the fragmentary view FIG. 8, which is similar to FIG. 6. The flanges 144 are received into the opposed channels 174 which extend down from the top wall 168 of the shroud. The flanges are in the same horizontal plane and extend in opposite directions being supported respectively by the webs 142.

Figure 9:
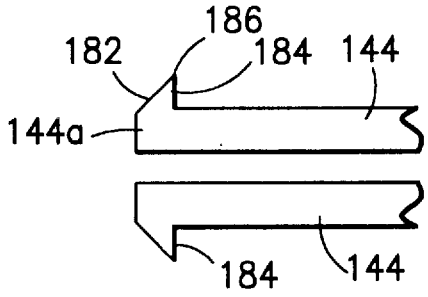
FIG. 9 is a fragmentary top plan view of the FIG. 8 modified flanges.
Figure 10:
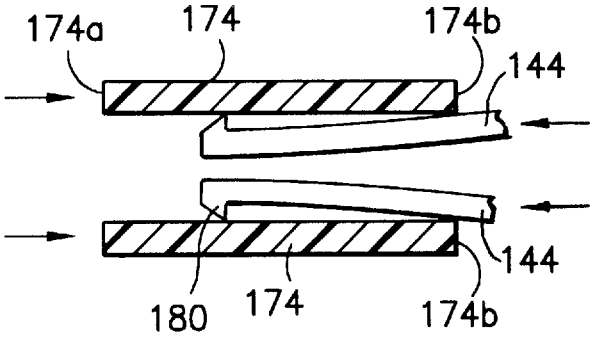
FIG. 10 is a fragmentary sectional view taken on the line 10—10 of FIG. 8 showing the flanges sliding into the channels.

The flanges 144, as shown in FIG. 9, are formed with hooks 180 which extend outward from the rearward edge thereof. The hooks have an inclined front surface 182 and a rear surface 184 perpendicular to the length of the flange. They cooperate with the rearward end 174*a* (FIGS. 10, 11,) in holding the flanges from lengthwise displacement out of the channels. In the assembly of the modification, the rearward end 144*a* of the channels of the flanges are aligned with the longitudinal slots of the respective channels 174

In assembly, with the channels 174 aligned with the respective flanges 144, the shroud is brought forward in a uni-directional movement. The entry of the channels 174*b* (FIG. 10) may be bevelled in their inner edges to provide a lead-in for the hooks 180. As the channels progress over the rearward end 144*a* of the flanges, the rear ends of the flanges are squeezed together (FIG. 10) by the channels, flexing the webs 142 as shown. When the hooks 180 reach the rearward surface 174*a* of the channel, the rearward end of the flanges snap out restoring the flanges to normal shape. At this point (FIG. 11) the surfaces 184 of the hooks 180 block the return of the flanges lengthwise of the channel, and therefore, the removal of the pump body 112 (comparable to body 12, FIG. 4).

Figure 11:
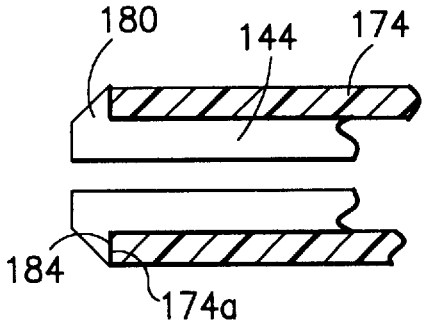
FIG. 11 is a fragmentary sectional view similar to FIG. 10 but showing the modified flanges snapped out in installed position.

Preferably, the engagement described in connection with FIGS. 8 and 11 is coupled with a shelf/shoulder arrangement such as 50, 78 of the FIG. 4 version. It may be, however, while not preferred, that if the channels 174 or 74 are of sufficient length and the flanges 144, 44 are also, suitable stability of the mounting of the shroud on the pump body can be established without the shelf/shoulder arrangement. In any event, the provision of the snap lock, such as the locking ramp 76 and latching section 44*b* or in the modification the hook 180 with the locking channel 174 or some similar snap arrangement, is necessary to afford secure attachment.

In the preferred embodiment and the modification, the invention may be regarded as a method of assembly which involves the lining up of the flanges of the respective channels and the forward movement of the shroud over the pump body in a uni-directional linear movement to a position at which the snap engagement of the latch section 44*b* over the wedge 76 or the hooks 180 over the ends 174*a* of the channels 174.

For purposes of the definition of the invention, "latching means" refers to a flexing element, a portion of the flanges 44 which bends to permit passage of a solid part of the shroud and then snaps back and is trapped behind the solid part precluding disassembly. "Locking means" refers to that solid part of the shroud. Illustratively the "locking means" is the wedge 76 with backside 76*b* or the channels 174 with backside 174*a*. For effecting the flexing of the flanges, there is a "cam surface means", illustratively the sloping surface 76*a* of the wedge or the sloping front 182 of the hooks 180.

Further variations in the invention are possible. Thus, while the invention has been shown in limited embodiments, it is not so limited but is of a scope defined by the following claim language which may be broadened by an extension of the right to exclude others from making, using or selling the invention as is appropriate under the doctrine of equivalents.

What is claimed is:

1. A trigger-type dispensing pump comprising a. a pump body having pump means and being adapted to mount a pivoted trigger for operating the pump means, the pump body being further defined by a tubular support adapted to be connected to a container and supporting the pump means and a substantially horizontal outlet tube connected to the pump means, the body formed with elongate flanges integral therewith, the flanges being disposed in a common horizontal plane and extending in directions away from each other, at least one of the flanges having an interruption to define a rear latching section and a forward support section, the tubular support being formed with an integral downwardly facing shelf spaced below the flanges, b. an open-fronted shroud adapted to substantially cover the pump body and comprising an elongate top wall and connecting side walls and rear end wall, the shroud adapted to slide over the pump body from a rearward direction, the shroud being formed with opposed spaced channels therealong adapted to slidingly receive respectively the flanges on the pump body, and at least one integral downward locking wedge adapted to engage the rear latching section deflecting it downward and permitting it to snap back to its original position after passage of the locking wedge to latch the shroud on the pump body, and an inward horizontal shoulder adjacent the rear end wall and vertically spaced from the channels and adapted to slide snugly under the shelf on the pump body.

2. A dispensing pump as claimed in claim 1 wherein the channels extend downward from the top wall of the shroud.

3. A dispensing pump as claimed in claim 1 wherein the shelf is reinforced from above by buttressing webs unitary with the rear wall.

4. A dispensing pump as claimed in claim 1 wherein both the shroud and the pump body are molded from polypropylene.

5. A dispensing pump as claimed in claim 1 wherein both flanges have aligned interruptions and rear latching sections.

6. A dispensing pump as claimed in claim 1 wherein the flanges are each supported on a web which extends upward from the horizontal outlet tube.

7. A dispensing pump as claimed in claim 6 wherein the rear latching section has a portion separated from the web by a slot.

8. A dispensing pump as claimed in claim 1 wherein the shoulder is integrally formed inward from the rear end wall and portions of the side walls.

9. A dispensing pump as claimed in claim 1 wherein a pair of locking wedges are provided and are aligned with the respective channels and are wedge-shaped and include a sloping portion facing a channel and an abrupt vertical rear end.

10. For a trigger-type dispensing pump a unitary molded open-fronted shroud defined by connected top wall, rear end wall and side walls, the top wall having a front portion and having spaced downward opposed parallel channels in the front portion and locking wedges extending downward toward the rear end wall and aligned with the respective channels, the locking wedges each having sloping portions facing its aligned channel and an abrupt vertical rear end, the rear end wall of the shroud being formed with an inward shoulder spaced downward from the channels.

11. A shroud as claimed in claim 10 wherein the rear end wall of the shroud is formed with a peak.

12. A shroud as claimed in claim 10 wherein the shoulder is connected to the side walls as well as the rear end wall.

13. An assembly for a trigger-type dispensing pump comprising a pump body having pump means and being adapted to mount a pivoted trigger for operating the pump means, the pump body being further defined by a tubular support adapted to be connected to a container and supporting the pump means and a substantially horizontal outlet tube connected to the pump means, the body formed with a pair of elongate flanges integral therewith, the flanges being disposed in a common horizontal plane and extending in directions away from each other, at least one of the flanges having an interruption to define a rear latching section and a forward support section, the tubular support being formed with an integral downwardly facing shelf spaced below the flanges, and an open-fronted shroud substantially covering the pump body and comprising an elongate top wall and connecting side walls and rear end wall, the shroud being formed with opposed spaced channels therealong embracing respectively the flanges on the pump body, and at least one integral downward locking wedge disposed in the interruption and an inward horizontal shoulder adjacent the rear end wall and vertically spaced from the channels and disposed snugly under the shelf on the pump body.

14. An assembly as claimed in claim 13 wherein the channels extend downward from the top wall of the shroud.

15. An assembly as claimed in claim 13 wherein the shelf is reinforced from above by buttressing webs unitary with the tubular support.

16. An assembly as claimed in claim 13 wherein both the shroud and the pump body are molded from polypropylene.

17. An assembly as claimed in claim 13 wherein both flanges have aligned interruptions and rear latching sections.

18. An assembly as claimed in claim 13 wherein the flanges are each supported on a web which extends upward from the horizontal outlet tube.

19. An assembly as claimed in claim 18 wherein the rear latching section has a portion separated from the web by a slot.

20. An assembly as claimed in claim 13 wherein the shoulder is integrally formed inward from the rear end wall and portions of the side walls.

21. An assembly as claimed in claim 13 wherein the locking wedge includes a sloping portion facing an adjacent channel and an abrupt vertical rear end.

22. A trigger-type dispensing pump comprising a. a pump body having pump means and being adapted to mount a pivoted trigger for operating the pump means, the pump body being further defined by a tubular support adapted to be connected to a container and supporting the pump means and a substantially horizontal outlet tube connected to the pump means, the body formed with integral elongate flanges integral therewith, the flanges being disposed in a common horizontal plane and extending in directions away from each other, at least one of the flanges being formed with latching means, b. an open-fronted shroud adapted to substantially cover the pump body and comprising an elongate top wall and connecting side walls and rear end wall, the shroud adapted to slide over the pump body from a rearward direction, the shroud being formed with opposed horizontal spaced channels therealong adapted to slidingly receive respectively the flanges on the pump body, and locking means on the shroud adapted to engage the latching means and deflect it and permitting it to snap back to its original position after passage of the locking means to hold the shroud on the pump body.

23. A trigger-type dispensing pump as claimed in claim 22 wherein one of the locking means or latching means is formed with cam surface means to assist in the flexing of the latching means.

24. A trigger-type dispensing pump as claimed in claim 22 wherein the flanges are each interrupted to define a front support section and a rear latching section comprising the latching means and the shroud is formed with a locking wedge comprising the locking means and having a sloping forward surface and a rearwardly facing vertical surface.

25. A trigger-type dispensing pump as claimed in claim 22 wherein at least one of the flanges is formed with an outward hook comprising the latching means and comprising a rearwardly facing sloping surface and a forwardly facing vertical surface formed forward of the sloping surface and a rearwardly facing perpendicular surface at the rear of one of the channels comprises the locking means.

26. For a trigger-type dispensing pump a unitary molded open-fronted shroud defined by connected top wall, rear end wall and side walls, the top wall having a front portion and having spaced downward opposed horizontally aligned parallel channels in the front portion and locking wedges extending downward toward the rear end wall and aligned with the respective channels, the locking wedges each having sloping portions facing its aligned channel and an abrupt vertical rearwardly facing rear end wall.

27. A method of assembly of a trigger pump comprising a pump body having a pump means connected to a substantially horizontal outlet tube and an open-fronted shroud defined by a top wall and connected rear end wall and opposite side walls, the method comprising:

a. providing on the outlet tube of the pump body a pair of outward coplanar flanges formed with deflectable latching means thereon, b. providing on the top wall of the shroud a pair of downward opposed horizontal channels adapted to slidingly receive the respective flanges and locking means on the shroud, c. placing the shroud to the rear of the pump body with the channels aligned with the respective flanges and d. moving the shroud forward in a uni-directional linear movement so that the flanges pass into the respective channels and the latching means engage and are deflected by the locking means and the latching means, after passing the locking means, return to undeflected condition and latch behind the locking means.

* * * * *